United States Patent [19]

Burton et al.

[11] 4,297,045

[45] Oct. 27, 1981

[54] PAPER FEED SYSTEM FOR A TYPEWRITER OR THE LIKE

[75] Inventors: Robert L. Burton; Thomas P. Finan, both of Lexington, Ky.

[73] Assignee: International Business Machines Corporation, Armonk, N.Y.

[21] Appl. No.: 77,884

[22] Filed: Sep. 21, 1979

[51] Int. Cl.[3] ..... B41J 13/076; B41J 13/048

[52] U.S. Cl. ..... 400/641; 400/506; 271/274

[58] Field of Search ..... 400/641, 506, 511, 497; 271/261, 272–275

[56] References Cited

U.S. PATENT DOCUMENTS

| | | | |
|---|---|---|---|
| 1,242,343 | 10/1917 | Gillespie | 271/264 |
| 2,052,566 | 9/1936 | Haines | 400/641 |
| 2,233,955 | 3/1941 | Miller | 400/641 |
| 2,328,624 | 9/1943 | Dodge | 400/641 |
| 2,356,842 | 8/1944 | Helmond | 400/641 |
| 2,767,821 | 10/1956 | Girouard | 400/641 |
| 3,042,179 | 7/1962 | Stern | 400/637.3 |
| 3,635,466 | 1/1972 | Townsend | 271/272 |
| 3,749,221 | 7/1973 | Busch | 400/641 |
| 3,788,638 | 1/1974 | Lehmann | 271/272 |
| 3,840,223 | 10/1974 | Nakata | 271/272 |
| 3,929,327 | 12/1975 | Olson | 271/272 |
| 3,988,984 | 11/1976 | Lindelov et al. | 101/93.03 |

FOREIGN PATENT DOCUMENTS

| | | | |
|---|---|---|---|
| 677518 | 6/1939 | Fed. Rep. of Germany | 400/641 |

OTHER PUBLICATIONS

Jenny et al. "Paper Handling Apparatus . . . " IBM Tech. discl. Bulletin vol. 20 No. 12, p. 5221, 05/78.

*Primary Examiner*—William Pieprz

*Attorney, Agent, or Firm*—Frank C. Leach, Jr.; George E. Grosser

[57] ABSTRACT

A paper feed system for a typewriter has its rear feed rollers formed to have minimum shingling and prevent treeing when a plurality of sheets of paper is fed between the platen and the rear feed rollers by rotation of the platen. Each of the rear feed rollers includes an annular outer portion, which is formed of an elastomeric material having a hardness of 30 to 35 Shore A durometer, supported on a hub, which is non-flexible so as to be relatively rigid, having a pair of flanges on opposite sides of the annular outer portion. Each of the annular outer portions has its thickness equal to or less than its width with the spacing between adjacent annular outer portions being greater than the width of each of the annular outer portions.

17 Claims, 6 Drawing Figures

PAPER FEED SYSTEM FOR A TYPEWRITER OR THE LIKE

In a paper feed system for a typewriter, paper is initially fed between a rotatable platen and rear feed roller means, which are in engagement with the platen so as to be driven by the platen rotating, for advancement therebetween along a predetermined path by rotation of the platen. As the paper is advanced, it is deflected to follow the circumference of the platen and pass between front feed roller means, which are in engagement with the platen so as to be driven by the platen rotating, and the platen prior to being disposed at the position at which characters may be typed thereon.

When a carbon pack, which comprises a plurality of interleaved and unconnected sheets of paper on which characters are typed and carbon paper, is fed into a typewriter, it is desired that this feeding occur without shingling, which is relative shifting between the sheets of paper and carbon paper because of the relative low coefficient of friction of each of the carbon papers with the sheet of paper adjacent its side not having the carbon material.

With the carbon pack being inserted, rear feed rollers of the rear feed roller means have previously been separated from the platen because the rear feed rollers have previously been hard and would not compress sufficiently to have a portion remain in contact with the platen as the carbon pack is initially fed between the platen and the rear feed rollers of the rear feed roller means. Thus, shingling has occurred with the prior paper feed systems when feeding a carbon pack, for example.

When shingling occurs, the typist must attempt to manually straighten the sheets of paper and carbon paper after release of the front and rear feed roller meaans from engagement with the platen. This is a time consuming task in which the typist's fingers can become smudged as can a sheet of paper by the adjacent sheet of carbon paper.

When one or more sheets of paper is fed into the typewriter, it is desired that the sheets of paper not be creased, which is called treeing. This creasing can occur when portions of the paper are fed towards each other by the adjacent rollers, for example, of the rear feed roller means.

As the material of the rollers of the rear feed roller means becomes softer, the possibility of treeing increases because the rollers tend to grab the sheets of paper better. Thus, if the softness of the rollers of the rear feed roller means is increased to enable contact with the platen to remain for a longer period of time as a carbon pack is inserted to avoid shingling, treeing can occur.

It also is desired that the paper be fed straight so that there is no skewing. This avoids the necessity of the typist having to attempt to straighten the paper after it has been fed.

It further is desired for the paper feed system of a typewriter to be able to have the sheet or sheets of paper move in either direction by rotation of the platen without having misalignment of the line at the typing line position at which the characters are typed on the paper. Thus, in an automatic correcting typewriter in which it is desired to correct a mistake after the paper has been advanced from the line in which the error occurred, it is necessary to roll back the platen to position the line of the paper at which the correction is to be made at the typing line position.

Automatic correcting requires precise positioning of the line, which is to be corrected, at the typing line position. Then, it is necessary to manually rotate the platen in the opposite direction to again return the paper to the line at which the typing was occurring unless typing of the sheet of paper has been completed. This also would be true for a typewriter without automatic correction in which an error is corrected by placing a correcting tape over the error and typing the correct character.

In a typewriter without automatic correction, it is necessary to manually rotate the platen to advance the line of type on the sheet of paper to a position in which the typist can erase the error. Then, the typist must roll back the platen so that the line is again at the typing line position for the corrected character or characters to be typed without the corrected character or characters being out of alignment with adjacent typed characters.

This problem of accurate positioning of the paper or papers upon rollback of the platen is particularly pronounced when the sheets of paper are advanced into the typewriter by power means through power indexing of the platen rather than manually and then having rollback of the platen manually. This is because rotation of the platen by power means produces a higher acceleration than is obtained by manual rotation of the platen, and higher acceleration produces more slippage than manual rotation.

Therefore, to obtain quality print on a plurality of sheets of paper hving carbon paper interleaved therewith, it is necessary that there be a minimum of shingling, no treeing, a minimum of skewing, and accurate positioning of the paper upon rollback of the platen. This must be accomplished without an imprint being formed on any of the sheets of paper by the adjacent sheet of carbon paper because of the force exerted by the rear feed rollers against the platen.

Instead of using rear feed roller means, it also has previously been suggested to utilize flexible belts for feeding a carbon pack. However, the flexible belts slip relative to the paper during each carriage return. There also is different slippage during rollback of the platen. Thus, the belts will not produce precise positioning of a line at the typing line position during rollback of the platen.

The improved feed system of the present invention satisfactorily solves the foregoing problems through providing an arrangement in which a carbon pack may be fed into a typewriter without treeing or carbon imprint and with minimum shingling or skewing while having accurate paper positioning upon rollback of the platen. The improved paper feed system of the present invention accomplishes this through utilizing a plurality of rear feed rollers spaced from each other with each roller having its circumference formed of a material sufficiently compressible to enable a portion of each of the rear feed rollers to remain in engagement with the rotating platen so as to be driven thereby when another portion of the rear feed rollers has the carbon pack between the rear feed rollers and the platen.

This material also must have a sufficiently high coefficient of friction with the material of the platen so that the rear feed rollers are driven by the platen and a sufficiently high coefficient of friction with the sheets of paper so that the rear feed rollers advance the paper in conjunction with the platen.

By forming each of the rear feed rollers of a relatively narrow width and with lateral stability, treeing is avoided notwithstanding the relatively high coefficient of friction between the rear feed rollers and the platen whereby the rollers would tend to grab the sheets of paper. By having a plurality of the rear feed rollers spaced from each other with each of the rear feed rollers having lateral stability, substantially equal feed of the carbon pack occurs so that skewing is avoided.

An object of this invention is to provide a unique rear feed roller means for feeding paper to a typewriter or the like.

Another object of this invention is to provide an arrangement for precisely feeding a plurality of sheets of paper between a platen and rear feed roller means by power or manual indexing.

The foregoing and other objects, features, and advantages of the invention will be apparent from the following more particular description of the preferred embodiment of the invention as illustrated in the accompanying drawings.

Figure 1:
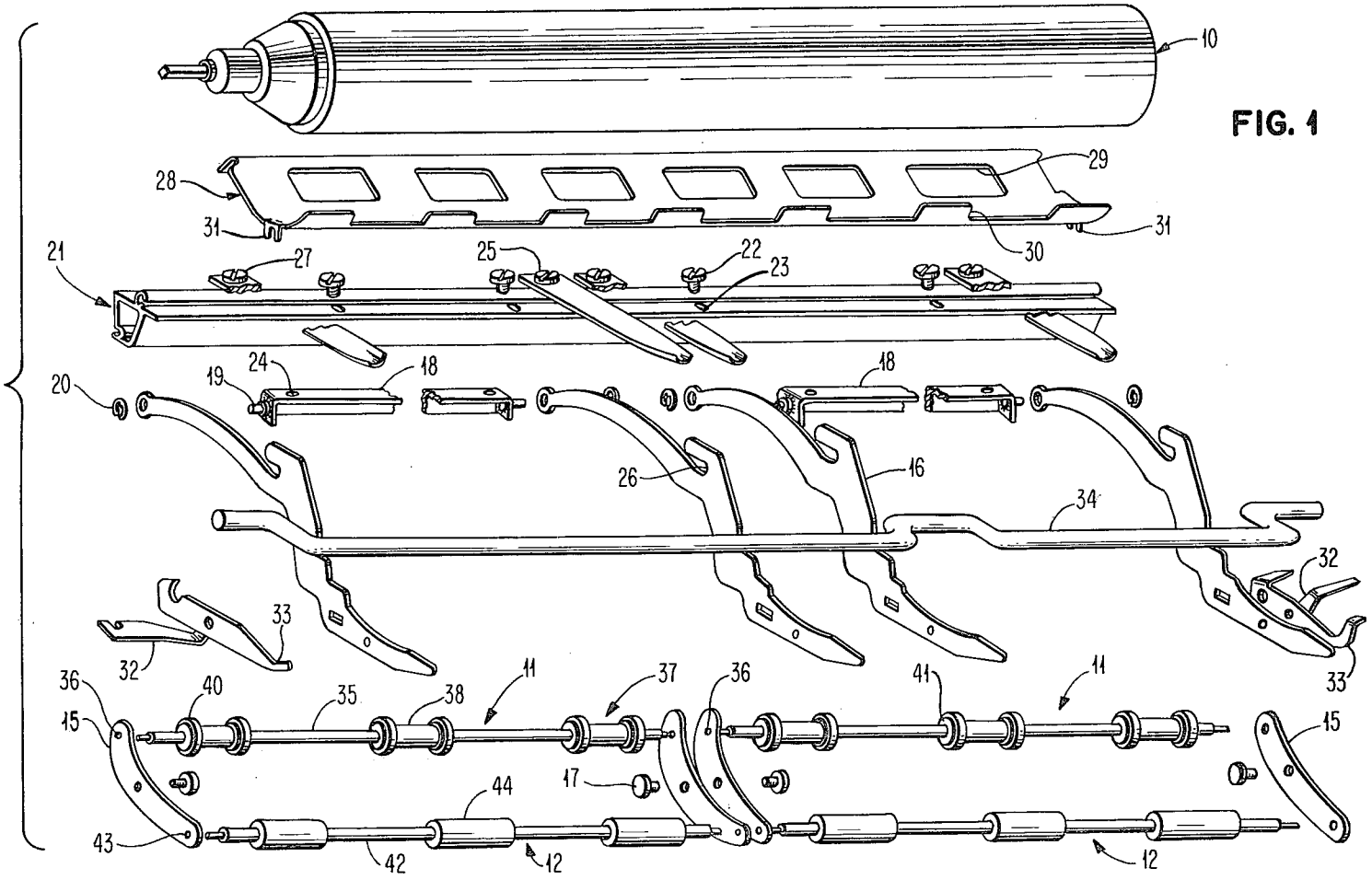
FIG. 1 is an exploded perspective view of a portion of a typewriter having the improved paper feed system of the present invention.
Figure 2:
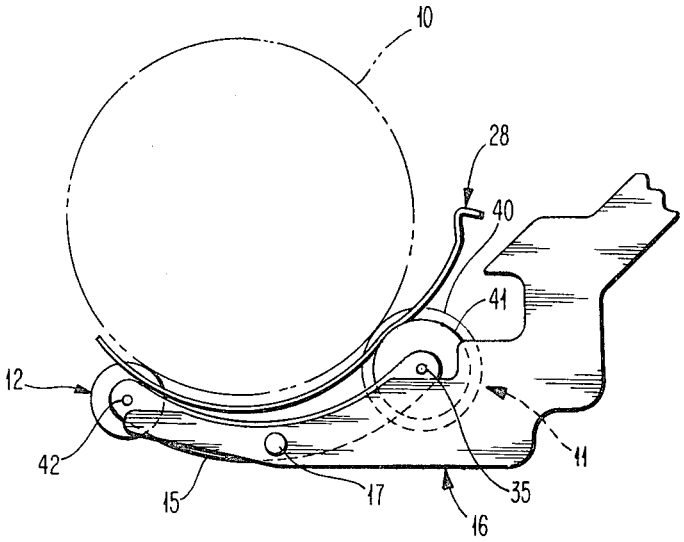
FIG. 2 is a schematic side elevational view of the improved paper feed system of the present invention.

Referring to the drawings and particularly FIG. 1, there is shown a platen 10, which is rotatably mounted in a pair of side plates fixed to a frame of a typewriter in the well-known manner. The platen 10 is rotatably mounted in the side plates for manual rotation in either direction or for being power indexed in one direction in the manner more particularly shown and described in the copending patent application of J. J. Bisczat et al for "Signal Controlled Indexing Rate Shifter For A Typewriter," Ser. No. 945,953, filed Sept. 26, 1978 and assigned to the same assignee as the assignee of this application.

Figure 3:
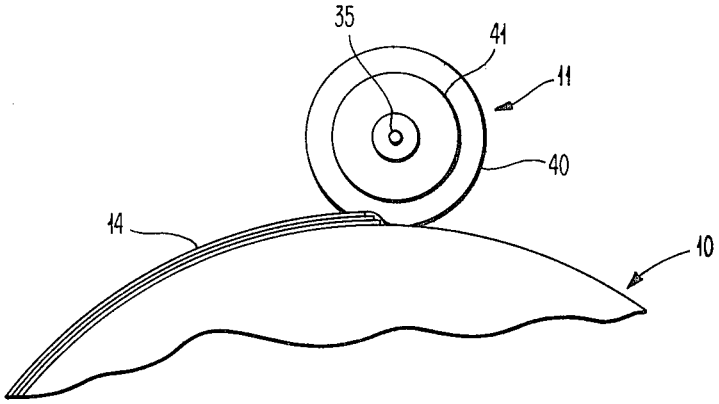
FIG. 3 is a schematic view showing a plurality of sheets of paper being fed between a rear feed roller and a platen with the rear feed roller compressing relative to the platen.

The platen 10 has rear feed roller means 11 and front feed roller means 12 cooperating therewith to cause a plurality of sheets 14 (see FIG. 3) of paper to be advanced when the platen 10 is rotated in either direction. Advancement of the sheets 14 of paper, which may be a carbon pack, for example, to the position in which characters may be typed thereon by the typewriter is by the sheets 14 of paper initially passing between the platen 10 and the rear feed roller means 11.

As shown in FIG. 1, there are two of the rear feed roller means 11 with each of the rear feed roller means 11 being rotatably supported by a pair of cradles 15. There also are two of the front feed roller means 12 with each of the front feed roller means 12 being supported by a pair of the cradles 15, which support one of the rear feed roller means 11.

Each pair of the cradles 15 is mounted on a pair of paper feed arms 16 by studs 17, which are hot upset into one of the arms 16. Each pair of the arms 16 is secured to opposite ends of an adjuster bar 18 by studs 19, which are hot upset into the adjuster bar 18 and have the arms 16 pivotally mounted thereon, and C-clips 20 cooperating with the studs 19.

Each of the adjuster bars 18 is adjustably mounted on a paper feed extrusion 21, which is fixed to the side plates, by screws 22 extending through elongated slots 23 in the extrusion 21 into threaded holes 24 in the adjuster bar 18. This arrangement enables adjustment of the rear feed roller means 11 and the front feed roller means 12 relative to the platen 10 for proper positioning.

Each of the feed arms 16 has one end of a relatively flat spring 25 slightly curved and disposed within a notch 26 in the arm 16 to urge each of the rear feed roller means 11 and each of the front feed roller means 12 upwardly against the platen 10. Each of the springs 25 has its other end secured to the extrusion 21 by a screw 27.

A curved deflector 28 is positioned adjacent the platen 10 and has longitudinally spaced rectangular shaped openings 29 therein to enable each of the two rear feed roller means 11 to engage the platen 10 when the sheets 14 (see FIG. 3) of paper are not present. The deflector 28 (see FIG. 1) also has longitudinally spaced slots 30 extending inwardly from one edge thereof to enable each of the two front feed roller means 12 to engage the platen 10 when the sheets 14 (see FIG. 3) of paper are not present.

The deflector 28 (see FIG. 1) is supported through having a pair of downwardly depending fingers 31 on each end cooperating with a projection 32 of a deflector support 33. The two deflector supports 33 are mounted on the exterior of the two outermost arms 16 by the studs 17, which mount the two exterior cradles 15 on the two outermost paper feed arms 16.

Each of the rear feed roller means 11 and each of the front feed roller means 12 are moved away from the platen 10 and against the force of the springs 25 by a bail 34, which has its opposite ends rotatably supported by the side plates. A lever (not shown) moves the bail 34 when it is desired to remove each of the rear feed roller means 11 and each of the front feed roller means 12 away from engagement with the platen 10 to which they are urged by the force of the springs 25.

Each of the rear feed roller means 11 includes a shaft 35, which has its ends rotatably mounted in openings 36 in the cradles 15. Each of the shafts 35 has three roller supports 37 mounted thereon in longitudinally spaced relation to each other for rotation therewith. The roller supports 37 are formed of any suitable non-flexible material such as acetal plastic sold as Delrin, for example. The roller supports 37 are press fitted on the shaft 35 at desired locations so that each is aligned with one of the rectangular shaped openings 29 in the deflector 28.

Figure 4:
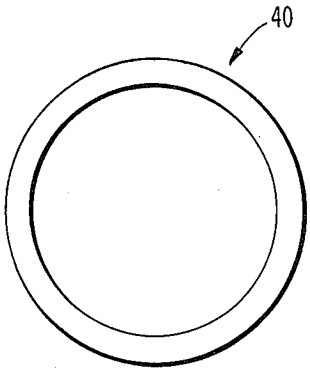
FIG. 4 is a plan view of an annular outer portion of a rear feed roller of the improved paper feed system of the present invention.
Figure 5:
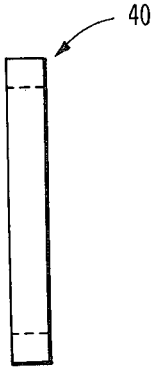
FIG. 5 is a side elevational view of the annular outer portion of FIG. 4.
Figure 6:
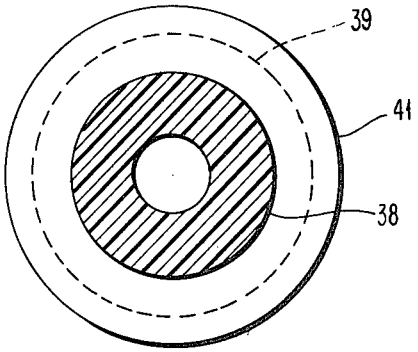
FIG. 6 is a fragmentary sectional view of a portion of the structure for supporting the annular outer portion of FIG. 4.

Each of the roller supports 37 includes a central cylindrical connecting portion 38 and a hub 39 (see FIG. 6) at each end of larger diameter than the central cylindrical connecting portion 38. An annular outer portion 40 (see FIGS. 1, 4, and 5) is mounted on the hub 39 (see FIG. 6) between a pair of flanges 41 of the hub 39. Thus, each of the hubs 39 and the annular outer portion 40 (see FIGS. 1, 4, and 5) mounted thereon comprises one of the rear feed rollers of each of the rear feed roller means 11.

The annular outer portion 40 is formed of a molded elastomeric material such as rubber or neoprene, for example. The elastomeric material of the annular outer portion 40 is sufficiently compressible, as shown exaggerated in FIG. 3, that a portion of the annular outer portion 40 remains in contact with the platen 10 even though the sheets 14 of paper have been inserted between the annular outer portion 40 and the platen 10. Thus, driving engagement from the platen 10 to the annular outer portion 40 remains so that the annular outer portion 40 does not cease to engage the platen 10 when the sheets 14 of the paper are inserted.

Tests have indicated that neoprene having a hardness between 30 and 35 Shore A durometer meets this requirement when the material of the platen 10 is styrene rubber having a hardness of about 91 Shore D durometer and each of the springs 25 (see FIG. 1) exerts a force of 1.1 to 1.3 pounds (4.9 to 5.8 newtons) between the rear feed roller means 11 and the platen 10. At the same time, neoprene with this hardness has a sufficiently high coefficient of friction between the material of the annular outer portion 40 and the material of the platen 10 for each of the annular outer portions 40 to be driven by the platen 10 to aid in feeding the sheets 14 (see FIG. 3) of paper between the platen 10 and the annular outer portions 40 of each of the rear feed roller means 11. The neoprene with this hardness also has a sufficiently high coefficient of friction with the sheets 14 of the paper so that there is driving of each of the rear feed roller means 11 from the platen 10 through the sheets 14 of the paper.

Each of the annular outer portions 40 has a thickness equal to or less than its width. The width of each of the annular outer portions 40 is the same and is preferably within the range of $\frac{1}{8}''$ (3.175 mm) to $\frac{1}{4}''$ (6.35 mm). If the thickness of the annular outer portion 40 were to exceed its width, the annular outer portion 40 would tend to buckle sidewise and possibly produce treeing.

Each of the annular outer portions 40 is spaced a greater distance in the direction of the longitudinal axis of the shaft 35 (see FIG. 1) from the next of the annular outer portions 40 than the width of the annular outer portion 40. As shown in FIG. 1, the annular outer portions 40 on each of the roller supports 37 are closer to each other in the direction of the longitudinal axis of the shaft 35 than each of the annular outer portions 40 is to the annular outer portion 40 on the next adjacent of the roller supports 37.

Each of the front feed roller means 12 includes a pair of shafts 42 with each of the shafts 42 having its opposite ends supported in an opening 43 in one of the cradles 15. Each of the shafts 42 has a plurality of hard cylindrical rollers 44, which are formed of a relatively hard material such as chlorosulfonated polyethylene sold under the trademark Hypalon by duPont and having a hardness of 50 Shore A durometer, held thereon by press fitting or clips and longitudinally spaced from each other. Each of the rollers 44 extends for substantially the same distance in the direction of the axis of the shaft 42 as the corresponding roller support 37 on the shaft 35. Thus, a substantially larger area of contact is made by each of the rollers 44 of the front feed roller means 12 than by the annular outer portion 40 of the rear feed roller means 11.

Accordingly, when the sheets 14 (see FIG. 3) of paper are fed between the platen 10 and the rear feed roller means 11, the compressibility of the material of each of the annular outer portions 40 of each of the rear feed roller means 11 enables contact to continue with the platen 10 for a period of time during which the sheets 14 of the paper are advancing between the platen 10 and the annular outer portions 40 of each of the rear feed roller means 11. This provides a substantially unitary drive from the platen 10 to each of the annular outer portions 40 of each of the rear feed roller means 11 to have substantially uniform advancement of the sheets 14 of paper with a minimum of shingling and without any treeing. Thus, acceleration of the rotatable platen 10 due to its powered advancement does not cause different feeding of the sheets 14 of paper than is obtained through manual rotation of the platen 10.

While the present invention has shown and described the roller supports 37 (see FIG. 1) as having two of the annular outer portions 40 mounted thereon, it should be understood that each of the rear feed roller means 11 could have each of the annular outer portions 40 formed on one of the hubs 39 without the central cylindrical connecting portion 38 and each of the hubs 39 press fitted on the shaft 35. This would be a more expensive way of producing the structure because of the additional number of parts produced, but the same results would be obtained.

While the present invention has shown and described the elastomeric material of the annular outer portions 40 as having a hardness of 30–35 Shore A durometer, it should be understood that this is the preferred example. Thus, the particular hardness of the material of the annular outer portions 40 would be selected in accordance with the hardness of the platen 10 and the force exerted by the springs 25 between the platen 10 and the rear feed roller means 11. The material of the annular outer portions 40 also must be selected so that the coefficient of friction between the platen 10 and the annular outer portions 40 is sufficiently high to have driving without slipping of the annular outer portions 40 relative to the platen 10 when the platen 10 is located.

However, it is believed that the hardness range of the material of the annular outer portions 40 cannot vary to any extent from the range of 30–35 shore A durometer because it is relatively expensive to manufacture materials having a hardness below 30 shore A durometer and sufficient compression is not obtained above 35 shore A durometer because the platen 10 must be relatively hard. Additionally, the force of the springs 25 cannot change significantly because an increased force could cause carbon imprint.

While the present invention has discussed the platen 10 as being power indexed to advance the sheets 14 (see FIG. 3) of paper, it should be understood that rollback of the sheets 14 of the paper also could be powered if desired. However, this is normally done by the typist when making corrections, and the typist controls the amount of rollback.

An advantage of this invention is that it enables a relatively large quantity of sheets of paper to be fed between a platen and rear feed roller means without treeing or a minimum of shingling. Another advantage of this invention is that it normally avoids the need for hand straightening the sheets of paper relative to each other after a plurality of sheets of paper has been fed to a typing position. A further advantage of this invention is that a plurality of sheets or paper is precisely fed in either direction manually or from a power source. Still another advantage of this invention is that positive driving of the sheets of paper is obtained without requiring a force to be exerted by the rear feed roller means of a magnitude to cause imprint of the rear feed roller means from one of the carbons to one of the sheets of paper on which printing is to occur.

While the invention has been particularly shown and described with reference to a preferred embodiment thereof, it will be understood by those skilled in the art that various changes in form and details may be made therein without departing from the spirit and scope of the invention.

What is claimed is:

1. In a paper feed system for a typewriter or the like including:

a rotatable platen;

rear feed roller means engageable with said platen when no paper is therebetween so as to be rotatable with said platen when said platen rotates;

and front feed roller means engageable with said platen when no paper is therebetween so as to be rotatable with said platen when said platen rotates;

the improvement comprising:

said rear feed roller means including a plurality of rear feed rollers engageable with said platen when no paper is therebetween so as to be rotatable with said platen when said platen rotates;

each of said rear feed rollers including an annular outer portion formed of a material sufficiently compressible when a plurality of sheets of paper with adjacent sheets having different coefficients of friction is simultaneously disposed between said platen and said rear feed rollers to have a portion of each of said rear feed rollers not having paper between said rear feed roller and said platen remain in engagement with said platen for driving of each of said rear feed rollers during rotation of said platen while another portion of each of said rear feed rollers has the sheets of paper between said rear feed roller and said platen until the rotation of said rear feed rollers advances the sheets of paper completely between each of said rear feed rollers and said platen, the material of each of said rear feed rollers having a sufficiently high coefficient of friction with the material of said platen for each of said rear feed rollers to be driven by said platen and a sufficiently high coefficient of friction with the sheets of paper for each of said rear feed rollers to advance the sheets of paper in conjunction with said platen, and the material of each of said rear feed rollers being sufficiently hard to avoid treeing;

said rear feed roller means including support means for each of said annular outer portions;

each of said annular outer portions having its width substantially less than its diameter;

and each of said annular outer portions having its thickness equal to or less than its width.

2. The improvement according to claim 1 in which:

said rear feed roller means includes a rotatably mounted shaft;

and said support means of said rear feed roller means includes:

a plurality of separate means mounted on said shaft for rotation therewith;

each of said separate mounted means including a pair of hubs spaced from each other in the direction of the longitudinal axis of said shaft;

each of said hubs supporting one of said annular outer portions and having a flange disposed on each side of said annular outer portion;

and each of said hubs being formed of a non-flexible material.

3. The improvement according to claim 2 in which each of said pair of hubs supports said annular outer portions in spaced relation to each other in the direction of the longitudinal axis of said shaft so that said annular outer portions are spaced a greater distance from each other than the width of each of said annular outer portions.

4. The improvement according to claim 3 in which the material of each of said annular outer portions is an elastomeric material having a hardness between 30 and 35 shore A durometer.

5. The improvement according to claim 1 in which said support means of said rear feed roller means includes a rotatably mounted hub of a non-flexible material, said hub having said annular outer portion mounted thereon.

6. The improvement according to claim 5 in which said annular outer portions are spaced a greater distance from each other than the width of each of said annular outer portions.

7. The improvement according to claim 6 in which the material of each of said annular outer portions is an elastomeric material having a hardness between 30 and 35 shore A durometer.

8. The improvement according to claim 1 in which the material of each of said annular outer portions is an elastomeric material having a hardness between 30 and 35 shore A durometer.

9. In a paper feed system for a typewriter or the like including:

a rotatable platen;

rear feed roller means engageable with said platen when no paper is therebetween so as to be rotatable with said platen when said platen rotates;

and front feed roller means engageable with said platen when no paper is therebetween so as to be rotatable with said platen when said platen rotates;

the improvement comprising:

said rear feed roller means including a plurality of rear feed rollers engageable with said platen when no paper is therebetween so as to be rotatable with said platen when said platen rotates;

each of said rear feed rollers having at least its circumference formed of the same material;

each of said feed rollers having at least its circumference formed of a material sufficiently compressible when a plurality of sheets of paper with adjacent sheets having different coefficients of friction is simultaneously disposed between said platen and said rear feed rollers to have a portion of each of said rear feed rollers not having paper between said rear feed roller and said platen remain in engagement with said platen for driving of each of said rear feed rollers during rotation of said platen while another portion of each of said rear feed rollers has the sheets of paper between said rear feed roller and said platen until the rotation of said rear feed rollers advances the sheets of paper completely between each of said rear feed rollers and said platen, the material of each of said rear feed rollers having a sufficiently high coefficient of friction with the material of said platen for each of said rear feed rollers to be driven by said platen and a sufficiently high coefficient of friction with the sheets of paper for each of said rear feed rollers to advance the sheets of paper in conjunction with said platen, and the material of each of said rear feed rollers being sufficiently hard to avoid treeing;

and the material of each of said annular outer portions is an elastomeric material having a hardness between 30 and 35 Shore A durometer.

10. The improvement according to claim 9 in which the elastomeric material is neoprene.

11. In a paper feed system for a typewriter or the like including:

a rotatable platen;

rear feed roller means engageable with said platen when no paper is therebetween so as to be rotatable with said platen when said platen rotates;

and front feed roller means engageable with said platen when no paper is therebetween so as to be rotatable with said platen when said platen rotates;

the improvement comprising:

said rear feed roller means including:

a rotatably mounted shaft;

and a plurality of rear feed rollers mounted on said shaft for rotation therewith and engageable with said platen when no paper is therebetween so as to be rotatable with said platen when said platen rotates, said rear feed rollers being spaced from each other in the direction of the longitudinal axis of the shaft;

and each of said rear feed rollers including:

a hub mounted on said shaft for rotation therewith;

said hub having an annular outer portion of an elastomeric material with a hardness between 30 and 35 Shore A durometer;

said hub having a flange disposed on each side of said annular outer portion;

and said hub being formed of a nonflexible material.

12. The improvement according to claim 11 in which:

said annular outer portion of each of said rear feed rollers has its width substantially less than its diameter;

and said annular outer portion of each of said rear feed rollers has its thickness equal to or less than its width.

13. The improvement according to claim 12 in which said annular outer portions are spaced a greater distance from each other than the width of each of said annular outer portions.

14. The improvement according to claim 11 including:

a plurality of separate means mounted on said shaft for rotation therewith;

and each of said separate mounted means including:

an adjacent pair of said hubs;

and means connecting the adjacent pair of said hubs to each other.

15. The improvement according to claim 14 in which said annular outer portion of each of said rear feed rollers has its thickness equal to or less than its width.

16. The improvement according to claim 15 in which each of said pair of hubs supports said annular outer portions in spaced relation to each other in the direction of the longitudinal axis of said shaft so that said annular outer portions are spaced a greater distance from each other than the width of each of said annular outer portions.

17. The improvement according to claim 11 in which the elastomeric material is neoprene.

* * * * *